US007012045B2

(12) United States Patent
Aoyagi et al.

(10) Patent No.: US 7,012,045 B2
(45) Date of Patent: Mar. 14, 2006

(54) METHOD OF IMPROVING THE FRICTIONAL PROPERTIES OF FUNCTIONAL FLUIDS

(75) Inventors: Edward I. Aoyagi, Petaluma, CA (US); Paul F. Vartanian, Oakland, CA (US)

(73) Assignee: Chevron Oronite Company LLS, San Ramon, CA (US)

( * ) Notice: Subject to any disclaimer, the term of this patent is extended or adjusted under 35 U.S.C. 154(b) by 74 days.

(21) Appl. No.: 10/838,990

(22) Filed: May 4, 2004

(65) Prior Publication Data

US 2004/0209787 A1 Oct. 21, 2004

Related U.S. Application Data

(63) Continuation-in-part of application No. 10/714,469, filed on Nov. 13, 2003, now abandoned, which is a continuation-in-part of application No. 10/206,732, filed on Jul. 26, 2002, now abandoned.

(51) Int. Cl.
*C10M 151/02* (2006.01)

(52) U.S. Cl. ..... 508/391; 508/390; 192/225; 192/12 C

(58) Field of Classification Search ..... 192/12 C, 192/225; 508/390, 391
See application file for complete search history.

(56) References Cited

U.S. PATENT DOCUMENTS 5,674,819 A * 10/1997 Sivik et al. ..... 508/234
6,410,491 B1 * 6/2002 Harrison et al. ..... 508/391

* cited by examiner

*Primary Examiner*—Fred Teskin
(74) *Attorney, Agent, or Firm*—S. G. K. Lee

(57) ABSTRACT

A method of improving the brake and clutch capacity of a functional fluid comprising adding a friction-modifying amount of a polyalkenyl sulfonate to the functional fluid, wherein the polyalkenyl sulfonate is an alkali metal or alkaline earth metal salt of a polyalkene sulfonic acid derived from a mixture of polyalkenes comprising greater than about 20 mole percent alkyl vinylidene and 1,1-dialkyl isomers.

31 Claims, No Drawings

METHOD OF IMPROVING THE FRICTIONAL PROPERTIES OF FUNCTIONAL FLUIDS

This application is a Continuation-in-Part of U.S. application Ser. No. 10/714,469 filed Nov. 13, 2003, now abandoned, which is a Continuation-in-Part of U.S. application Ser. No. 10/206,732, filed Jul. 26, 2002, now abandoned.

The present invention relates to functional fluids useful in systems requiring coupling, hydraulic fluids and/or lubrication of relatively moving parts. In particular, the present invention relates to a method of improving the brake and clutch capacity of functional fluids useful in wet clutch and/or wet brake systems, such as in automatic transmissions and tractors.

BACKGROUND OF THE INVENTION

Modern lubricating oil formulations are formulated to exacting specifications often set by original equipment manufacturers. To meet such specifications, various additives are used, together with base oil of lubricating viscosity. Depending on the application, a typical lubricating oil composition may contain dispersants, detergents, antioxidants, wear inhibitors, rust inhibitors, corrosion inhibitors, foam inhibitors just to name a few. Different applications will govern the type of additives that will go into a lubricating oil composition.

A functional fluid is a term which encompasses a variety of fluids including but not limited to tractor hydraulic fluids, automatic transmission fluids including continuously variable transmission fluids, manual transmission fluids, hydraulic fluids, power steering fluids, fluids related to power train components and fluids which have the ability to act in various different capacities. It should be noted that within each of these fluids such as, for example, automatic transmission fluids, there are a variety of different types of fluids due to the various transmissions having different designs which have led to the need for fluids of markedly different functional characteristics.

Tractor hydraulic fluids and automatic transmission fluids are examples of functional fluids having very specific friction requirements. Because such fluids work in wet brake and/or wet clutch systems, the fluid must assist in smooth engagement of these brakes and clutches while maintaining desirably high frictional properties for effective brakes and clutches. These fluids require high friction coefficients. For example, tractor hydraulic fluids that involve wet brake systems must have a high friction coefficient to be effective. Further, automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail.

SUMMARY OF THE INVENTION

The present invention provides a method of improving the brake and clutch capacity of a functional fluid, especially tractor hydraulic fluids, automatic transmission fluids including continuously variable transmission fluids, comprising adding to the functional fluid a friction-modifying amount of a polyalkenyl sulfonate having a Total Base Number (TBN) of about 0 to about 60 and is an alkali metal or alkaline earth metal salt of a polyalkenyl sulfonic acid derived from a mixture of polyalkenes comprising greater than 20 mole percent alkyl vinylidene and 1,1-dialkyl isomers.

The present invention further provides a method of improving the brake and clutch capacity of a functional fluid, especially tractor hydraulic fluids, automatic transmission fluids including continuously variable transmission fluids, comprising adding to the functional fluid a friction-modifying amount of a polyalkenyl sulfonate having a TBN of greater than about 60 to about 400 and is an alkali metal or alkaline earth metal salt of a polyalkenyl sulfonic acid derived from a mixture of polyalkenes comprising greater than about 20 mole percent alkyl vinylidene and 1,1-dialkyl isomers.

Preferably, the alkyl vinylidene isomer is a methyl vinylidene isomer and the 1,1-dialkyl isomer is a 1,1-dimethyl isomer.

The polyalkene employed has a number average molecular weight of about 168 to about 5,000. Preferably, the polyalkene is polyisobutene. More preferably, the polyalkene is polyisobutene and the molecular weight distribution of the polyisobutenyl sulfonic acids has at least about 80% of the polyisobutenyl sulfonic acids molecular weights separated by even multiples of about 56 daltons. Most preferably, the polyalkene is polyisobutene and less than about 20% of the polyisobutenyl sulfonic acids in the molecular weight distribution of the polyisobutenyl sulfonic acids contain a total number of carbon atoms that is not evenly divisible by about four.

A further embodiment of the present invention provides a method wherein the functional fluid is a tractor hydraulic fluid or an automatic transmission fluid.

Among other factors, the present invention is based on the surprising discovery that a friction-modifying amount of the polyalkenyl sulfonates of the present invention provides improved brake and clutch capacity when used in a functional fluid. The benefits of the present invention are apparent in functional fluids useful in systems requiring coupling and lubricating of relatively moving parts, such as wet clutch and/or brake systems, as in automatic transmissions and tractors. Other advantageous properties provided by the present invention are good stability, water dispersing properties, less foaming tendencies, and rust protection.

DETAILED DESCRIPTION OF THE INVENTION

Prior to discussing the present invention in detail, the following terms will have the following meanings unless expressly stated to the contrary.

Definitions

The term "alkaline earth metal" refers to calcium, barium, magnesium, strontium, or mixtures thereof.

The term "alkyl" refers to both straight- and branched-chain alkyl groups.

The term "alkylene" refers to straight- and branched-chain alkylene groups having at least 2 carbon atoms. Typical alkylene groups include, for example, ethylene ($—CH_2CH_2—$), propylene ($—CH_2CH_2CH_2—$), isopropylene ($—CH(—CH_3)CH_2—$), n-butylene ($—CH_2CH_2CH_2CH_2—$), sec-butylene ($—CH(CH_2CH_3)CH_2—$), n-pentylene ($—CH_2CH_2CH_2CH_2CH_2—$), and the like.

The term "metal" refers to alkali metals, alkali earth metals, or mixtures thereof.

The term "polyalkyl" or "polyalkenyl" refers to an alkyl or alkenyl group which is generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and -decene.

The term "Total Base Number" or "TBN" refers to the amount of base equivalent to the milligrams of KOH in 1 gram of sample. Thus, higher TBN numbers reflect more alkaline products and therefore a greater alkalinity reserve. The TBN of a sample can be determined by ASTM Test No. D2896 or any other equivalent procedure. In general terms, TBN is the neutralization capacity of one gram of the lubricating composition expressed as a number equal to the mg of potassium hydroxide providing the equivalent neutralization. Thus, a TBN of 10 means that one gram of the composition has a neutralization capacity equal to 10 mg of potassium hydroxide.

The term "low overbased" or "LOB" refers to an overbased polyalkenyl sulfonate having a low TBN of about 0 to about 60.

The term "high overbased" or "HOB" refers to an overbased polyalkenyl sulfonate having a high TBN of greater than about 60 to about 400.

As stated above, the present invention provides a method of improving the brake and clutch capacity of a functional fluid by adding a friction-modifying amount of a polyalkenyl sulfonate to the functional fluid. The polyalkenyl sulfonate is an alkali metal or alkaline earth metal salt of a polyalkenyl sulfonic acid derived from a mixture of polyalkenes comprising greater than about 20 mole percent alkyl vinylidene and 1,1-dialkyl isomers.

The Polyalkenyl Sulfonate

The polyalkenyl sulfonates of the present invention are prepared by reacting a polyalkenyl sulfonic acid (prepared as described below) with a source of an alkali metal or alkaline earth metal. The alkali metal or alkaline earth metal can be introduced into the sulfonate by any suitable means. One method comprises combining a basically reacting compound of the metal, such as the hydroxide, with the polyalkenyl sulfonic acid. This is generally carried out in the presence of a hydroxylic promoter such as water, alcohols such as 2-ethyl hexanol, methanol or ethylene glycol, and an inert solvent for the sulfonate, typically with heating. Under these conditions, the basically reacting compound will yield the metal sulfonate. The hydroxylic promoter and solvent can then be removed to yield the metal sulfonate.

Under certain circumstances, it may be more convenient to prepare an alkali metal polyalkenyl sulfonate and convert this material by metathesis into an alkaline earth metal sulfonate. Using this method, the sulfonic acid is combined with a basic alkali metal compound such as sodium or potassium hydroxide. The sodium or potassium sulfonate obtained can be purified by aqueous extraction. Then, the sodium or potassium sulfonate is combined with an alkaline earth metal salt to form the alkaline earth metal sulfonate. The most commonly used alkaline earth metal compound is a halide, particularly a chloride. Typically, the sodium or potassium sulfonate is combined with an aqueous chloride solution of the alkaline earth metal and stirred for a time sufficient for metathesis to occur. Thereafter, the water phase is removed and the solvent may be evaporated, if desired.

The preferred sulfonates are alkaline earth metal sulfonates, especially those of calcium, barium and magnesium. Most preferred are the calcium and magnesium sulfonates.

The polyalkenyl sulfonates of the present invention are either neutral or overbased sulfonates. Overbased materials are characterized by a metal content in excess of that which would be present according to the stoichiometry of the metal cation in the sulfonate said to be overbased. Thus, a monosulfonic acid when neutralized with an alkaline earth metal compound, such as a calcium compound, will produce a normal sulfonate containing one equivalent of calcium for each equivalent of acid. In other words, the normal metal sulfonate will contain one mole of calcium for each two moles of the monosulfonic acid.

By using well known procedures, overbased or basic complexes of the sulfonic acid can be obtained. These overbased materials contain amounts of metal in excess of that required to neutralize the sulfonic acid. Highly overbased sulfonates can be prepared by the reaction of overbased sulfonates with carbon dioxide under reaction conditions. A discussion of the general methods for preparing overbased sulfonates and other overbased products is disclosed in U.S. Pat. No. 3,496,105, issued Feb. 17, 1970 to LeSuer, which in incorporated by reference in its entirety.

The amount of overbasing can be expressed as a Total Base Number ("TBN"), which refers to the amount of base equivalent to the milligrams of KOH in one gram of sulfonate. Thus, higher TBN numbers reflect more alkaline products and therefore a greater alkalinity reserve. The TBN for a composition is readily determined by ASTM test method D664 or other equivalent methods. The overbased polyalkenyl sulfonates of this invention can have relatively low TBN, i.e., about 0 to about 60, more preferably, about 0 to about 30; or relatively high TBN, i.e., greater than about 60 to about 400, more preferably about 250 to about 350.

The polyalkenyl sulfonates of the present invention are useful as additives in functional fluids in amounts sufficient to provide improved brake and clutch capacity. They have good water dispersion properties, a light color and provide good performance characteristics.

Polyalkenyl Sulfonic Acid

The polyalkenyl sulfonic acids of the present invention are prepared by reacting a mixture of polyalkenes comprising greater than about 20 mole percent alkyl vinylidene and 1,1-dialkyl isomers with a source of sulfur trioxide —$SO_3$—. The source of —$SO_3$— can be a mixture of sulfur trioxide and air, sulfur trioxide hydrates, sulfur trioxide amine complexes, sulfur trioxide ether complexes, sulfur trioxide phosphate complexes, acetyl sulfate, a mixture of sulfur trioxide and acetic acid, sulfamic acid, alkyl sulfates or chlorosulfonic acid. The reaction may be conducted neat or in any inert anhydrous solvent. The conditions for sulfonation are not critical. Reaction temperatures can range from about −30° C. to about 200° C. and depends on the particular sulfonating agent employed. For example, acetyl sulfate requires low temperatures for reaction and elevated temperatures should be avoided to prevent decomposition of the product. Reaction time can vary from a few minutes to several hours depending on other conditions, such as reaction temperature. The extent of the reaction can be determined by titration of sulfonated polyalkene after any free sulfuric acid has been washed out. Typical mole ratios of sulfonating agent to polyalkene can be about 1:1 to about 2:1.

The preferred sulfonating agent is acetyl sulfate (or a mixture of sulfuric acid and acetic anhydride which forms acetyl sulfate in situ) which produces the polyalkenyl sulfonic acid directly. Other sulfonating agents, such as a mixture of sulfur trioxide and air, may produce a sultone intermediate that needs to be hydrolyzed to the sulfonic acid. This hydrolysis step can be very slow.

The polyalkenes used to prepare the polyalkenyl sulfonic acid are a mixture of polyalkenes having about 12 to about 350 carbon atoms. The mixture comprises greater than about 20 mole percent, preferably greater than about 50 mole percent, and more preferably greater than about 70 mole percent alkylvinylidene and 1,1-dialkyl isomers. The preferred alkylvinylidene isomer is a methyl vinylidene isomer, and the preferred 1,1-dialkyl isomer is a 1,1-dimethyl isomer.

The polyalkenes have a number average molecular weight in the range of about 168 to about 5,000. Preferably, the polyalkenes have number average molecular weights of about 350 to about 2,300; more preferably, about 350 to about 1,000; and most preferably, about 350 to about 750.

The preferred polyalkene is polyisobutene. Especially preferred are polyisobutenes made using $BF_3$ as catalyst.

U.S. Pat. No. 5,408,018, which issued on Apr. 18, 1995 to Rath and which is incorporated by reference in its entirety, and the references cited therein describe a suitable process for the production of polyisobutenes that contain greater than about 20 mole percent alkylvinylidene and 1,1-dialkyl isomers.

Typically, when polyisobutenyl sulfonic acids or sulfonates are prepared from polyisobutene having a mole percent of alkylvinylidene and 1,1-dialkyl isomers greater than about 20% is used to prepare polyisobutenyl sulfonic acids or sulfonates, the molecular weight distribution of the resulting product has at least about 80% of the polyisobutenyl sulfonic acids or sulfonates whose molecular weights are separated by even multiples of about 56 daltons. In other words, less than about 20% of the polyisobutenyl sulfonic acids or sulfonates in the molecular weight distribution of the sulfonic acids or sulfonates contain a total number of carbon atoms that is not evenly divisible by about four.

Functional Fluids

The functional fluids of the present invention use base oils derived from mineral oils, synthetic oils or vegetable oils. A base oil having a viscosity of at least about 2.5 cSt at about 40° C. and a pour point below about 20° C., preferably at or below 0° C., is desirable. The base oils may be derived from synthetic or natural sources. Base oils may be derived from any of one or combination of Group I through Group V base stocks as defined in American Petroleum Institute Publication 1509, which is herein incorporated for all purposes.

Mineral oils for use as the base oil in this invention include, for example, paraffinic, naphthenic and other oils that are ordinarily used in lubricating oil compositions.

Vegetable oils may include, for example, canola oil or soybean oil.

Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

The functional fluid of the present invention will contain a friction-modifying amount of the polyalkenyl sulfonate described herein. Typically, the polyalkenyl sulfonate contained in the functional fluid will range from about 0.1 wt. % to about 6.0 wt. %; preferably, from about 0.5 wt. % to about 5 wt. %; and more preferably, from about 1 wt. % to about 4 wt. %.

Besides the polyalkenyl sulfonate of the present invention, the functional fluid may also comprise other additives described below. These additional components can be blended in any order and can be blended as combinations of components.

Other Additive Components

The following additive components are examples of some of the components that can be favorably employed in the present invention. These examples of additives are provided to illustrate the present invention, but they are not intended to limit it:

A. Metal Detergents

Sulfurized or unsulfurized alkyl or alkenyl phenates, sulfonates derived from synthetic or natural feedstocks, carboxylates, salicylates, phenalates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic, acids, metal salts of an alkyl or alkenyl multiacid, and chemical and physical mixtures thereof.

B. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Antioxidants may include, but are not limited to, such anti-oxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butyl phenol), 4,4'-isopropylidene-bis(2,6-di-tert-bulylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butyl-phenol, 2,6-di-tert-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Other types of oxidation inhibitors include metal dithiocarbamate (e.g., zinc dithiocarbamate), and methylenebis (dibutyidithiocarbamate). The anti-oxidant is generally incorporated into an oil in an amount of about 0 to about 10 wt %, preferably 0.05 to about 3.0 wt %, per total amount of the engine oil.

C. Anti-Wear/Extreme Pressure Agents

As their name implies, these agents reduce wear of moving metallic parts. Examples of such agents include, but are not limited to, phosphates, phosphites, carbamates, esters, sulfur containing compounds, molybdenum complexes, zinc dialkyldithiophosphate (primary alkyl, secondary alkyl, and aryl type), sulfurized oils, sulfurized isobutylene, sulfurized polybutene, diphenyl sulfide, methyl trichlorostearate, chlorinated naphthalene, fluoroalkylpolysiloxane, and lead naphthenate.

D. Rust Inhibitors (Anti-rust Agents)

1) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

E. Demulsifiers

Addition product of alkylphenol and ethylene oxide, polyoxyethylene alkyl ether, and polyoxyethylene sorbitan ester.

F. Friction Modifiers

Fatty alcohols, 1,2-diols, borated 1,2-diols, fatty acids, amines, fatty acid amides, borated esters, and other esters.

G. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

H. Viscosity Index Improvers

Polymethacrylate type polymers, ethylene-propylene copolymers, styrene-isoprene copolymers, hydrogenated styrene-isoprene copolymers, polyisobutylene, and dispersant type viscosity index improvers.

I. Pour Point Depressants

Polymethyl methacrylate.

J. Foam Inhibitors

Alkyl methacrylate polymers and dimethyl silicone polymers.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Example 1

Preparation of Test Oils

The test fluids were prepared by dissolving 4.0 wt % sulfonates described in Table 1 in SAE 30 weight mineral base oil. The composition of the test fluids are shown in Table 2.

TABLE 1

Sulfonate Description

| | Type[a] | Feed Stock | % Ca | TBN |
|---|---|---|---|---|
| LOB Sulfonate of Invention | LOB sulfonate | Polyisobutene average mw = 550 | 2.55 | 14 |
| Comparative Example A | LOB sulfonate | Natural[b] | 2.33 | 19 |
| Comparative Example B | LOB sulfonate | Mixed (natural and synthetic) | 2.34 | 14 |
| HOB Sulfonate of Invention) | HOB sulfonate | Polyisobutene average mw = 550 | 12.3 | 296 |
| Comparative Example C | HOB sulfonate | Synthetic[c] | 12.7 | 320 |
| Comparative Example D | HOB sulfonate | Natural | 12.5 | 320 |

[a]LOB = low overbased
HOB = high overbased
[b]Sulfonation on feedstocks derived from crude oil
[c]Sulfonation on materials such as alkylaromatic compounds

TABLE 2

Test Fluid Compositions

| | Test Oil % Component in mixture | | | | | | |
|---|---|---|---|---|---|---|---|
| Component | 1 | 2 | 3 | 4 | 5 | 6 | 7 |
| LOB Sulfonate of Invention | 4.0 | | | | | | |
| Comparative Example A | | 4.0 | | | | | |
| Comparative Example B | | | 4.0 | | | | |
| HOB Sulfonate of Invention | | | | 4.0 | | | |
| Comparative Example C | | | | | 4.0 | | |
| Comparative Example D | | | | | | 4.0 | |
| Base Oil | 96.0 | 96.0 | 96.0 | 96.0 | 96.0 | 96.0 | 100.0 |

Example 2

Measurement of Friction Coefficients

Friction coefficients of the test fluids prepared in Example 1 were measured using a micro-clutch apparatus made by Komatsu Engineering and following the Komatsu KES 07.802 procedure. That is, the disc and the plates as specified in the procedure were contacted with the pressure of 4 kgf/cm$^2$ against the disc rotating at 20 rpm in presence of additive component dissolved in mineral oil. The friction coefficient was measured at room temperature (25° C.), 60° C., 80° C., 100° C., 120° C., and 140° C. The results shown in Table 3.

TABLE 3

Komatsu Micro-clutch Friction Test Results

| Test Fluid | Friction Coefficients at Indicated Test Temperatures | | | | | | |
|---|---|---|---|---|---|---|---|
| | 25° C. | 40° C. | 60° C. | 80° C. | 100° C. | 120° C. | 140° C. |
| 1 (Invention) | 0.162 | 0.168 | 0.173 | 0.182 | 0.184 | 0.185 | 0.181 |
| 2 | 0.151 | 0.152 | 0.156 | 0.157 | 0.152 | 0.146 | 0.138 |
| 3 | 0.147 | 0.151 | 0.153 | 0.147 | 0.141 | 0.133 | 0.126 |
| 4 (Invention) | 0.163 | 0.164 | 0.171 | 0.176 | 0.180 | 0.187 | 0.190 |
| 5 | 0.150 | 0.148 | 0.126 | 0.113 | 0.109 | 0.111 | 0.117 |
| 6 | 0.157 | 0.159 | 0.156 | 0.151 | 0.150 | 0.152 | 0.158 |
| 7 (Base Oil) | 0.162 | 0.164 | 0.163 | 0.158 | 0.153 | 0.149 | 0.149 |

From these results, it can been seen that the polyisobutenyl sulfonates of the present invention in Test Fluids 1 and 4 provided high frictional properties compared to the commercial comparative LOB or HOB sulfonates (Test Fluids 2, 3, 5, and 6) and the base oil (no sulfonate) (Test Fluid 7).

What is claimed is:

1. A method of improving the braking and clutch capacity of a functional fluid, said method comprising adding a friction-modifying amount of a polyalkenyl sulfonate to said functional fluid, said polyalkenyl sulfonate having a Total Base Number of about 0 to about 60 wherein said polyalkenyl sulfonate is an alkali metal or alkaline earth metal salt of a polyalkenyl sulfonic acid derived from a mixture of polyalkenes comprising greater than about 20 mole percent alkyl vinylidene and 1,1-dialkyl isomers.

2. The method according to claim 1, wherein the polyalkenyl sulfonate has a TBN of about 0 to about 30.

3. The method according to claim 1, wherein the mixture of polyalkenes comprises greater than about 50 mole percent alkyl vinylidene and 1,1-dialkyl isomers.

4. The method according to claim 1, wherein the mixture of polyalkenes comprises greater than about 70 mole percent alkyl vinylidene and 1,1-dialkyl isomers.

5. The method according to claim 1, 2, 3, or 4 wherein the alkyl vinylidene isomer is a methyl vinylidene isomer, and the 1,1-dialkyl isomer is a 1,1-dimethyl isomer.

6. The method according to claim 1, wherein the number average molecular weight of the mixture of polyalkenes is about 168 to about 5,000.

7. The method according to claim 1, wherein the number average molecular weight of the mixture of polyalkenes is about 350 to about 2,300.

8. The method according to claim 1, wherein the number average molecular weight of the mixture of polyalkenes is about 350 to about 1,000.

9. The method according to claim 1, wherein the number average molecular weight of the mixture of polyalkenes is about 350 to about 750.

10. The method according to claim 1, wherein the mixture of polyalkenes is a mixture of polyisobutenes.

11. The method according to claim 10, wherein the mixture of polyisobutenes is made using a $BF_3$ catalyst.

12. The method according to claim 1, wherein the mixture of polyalkenes is a mixture of polyisobutenes and the molecular weight distribution of the polyisobutenyl sulfonic acids has at least about 80% of the polyisobutenyl sulfonic acids molecular weights separated by even multiples of about 56 daltons.

13. The method according to claim 1, wherein the mixture of polyalkenes is a mixture of polyisobutenes and less than about 20% of the polyisobutenyl sulfonic acids in the molecular weight distribution of the polyisobutenyl sulfonic acids contain a total number of carbon atoms that is not evenly divisible by about four.

14. The method according to claim 1, wherein the functional fluid is an automatic transmission fluid or hydraulic fluid.

15. The method according to claim 14, wherein the functional fluid is a hydraulic fluid.

16. The method according to claim 15, wherein the hydraulic fluid is a tractor hydraulic fluid.

17. A method of improving the braking and clutch capacity of a functional fluid, said method comprising adding a friction-modifying amount of a polyalkenyl sulfonate to said functional fluid, said polyalkenyl sulfonate having a Total Base Number of greater than about 60 to about 400 wherein said polyalkenyl sulfonate is an alkali metal or alkaline earth metal salt of a polyalkenyl sulfonic acid derived from a mixture of polyalkenes comprising greater than about 20 mole percent alkyl vinylidene and 1,1-dialkyl isomers.

18. The method according to claim 17, wherein the polyalkenyl sulfonate has a TBN of about 250 to about 350.

19. The method according to claim 17, wherein the mixture of polyalkenes comprises greater than about 50 mole percent alkyl vinylidene and 1,1-dialkyl isomers.

20. The method according to claim 17, wherein the mixture of polyalkenes comprises greater than about 70 mole percent alkyl vinylidene and 1,1-dialkyl isomers.

21. The method according to claim 17, 18, 19, or 20 wherein the alkyl vinylidene isomer is a methyl vinylidene isomer, and the 1,1-dialkyl isomer is a 1,1-dimethyl isomer.

22. The method according to claim 17, wherein the number average molecular weight of the mixture of polyalkenes is about 168 to about 5,000.

23. The method according to claim 17, wherein the number average molecular weight of the mixture of polyalkenes is about 350 to about 2,300.

24. The method according to claim 17, wherein the number average molecular weight of the mixture of polyalkenes is about 350 to about 1,000.

25. The method according to claim 17, wherein the number average molecular weight of the mixture of polyalkenes is about 350 to about 750.

26. The method according to claim 17, wherein the mixture of polyalkenes is a mixture of polyisobutenes.

27. The method according to claim 26, wherein the mixture of polyisobutenes is made using a $BF_3$ catalyst.

28. The method according to claim 17, wherein the mixture of polyalkenes is a mixture of polyisobutenes and the molecular weight distribution of the polyisobutenyl sulfonic acids has at least about 80% of the polyisobutenyl sulfonic acids molecular weights separated by even multiples of about 56 daltons.

29. The method according to claim 17, wherein the mixture of polyalkenes is a mixture of polyisobutenes and less than about 20% of the polyisobutenyl sulfonic acids in the molecular weight distribution of the polyisobutenyl sulfonic acids contain a total number of carbon atoms that is not evenly divisible by about four.

30. The method according to claim 17, wherein the functional fluid is a tractor hydraulic fluid or an automatic transmission fluid.

31. The method according to claim 30, wherein the functional fluid is a tractor hydraulic fluid.

* * * * *